United States Patent [19]

Wright

[11] 4,100,874

[45] Jul. 18, 1978

[54] FLAP RUDDER

[76] Inventor: Delatte U. Wright, Star Rte. 1, Box 569F, Rockport, Tex. 78382

[21] Appl. No.: 786,481

[22] Filed: Apr. 8, 1977

[51] Int. Cl.[2] ..... B63H 25/06

[52] U.S. Cl. ..... 114/162

[58] Field of Search ..... 114/162, 163, 164, 167, 114/166, 135, 136, 143, 132, 137, 133, 134, 281; 115/42, 29, 28 R, 291

[56] References Cited

U.S. PATENT DOCUMENTS

| | | | |
|---|---|---|---|
| 595,161 | 12/1897 | Gibb | 114/137 |
| 1,500,584 | 7/1924 | Harley | 114/164 X |
| 1,795,346 | 3/1931 | Rebl | 114/162 |
| 3,515,089 | 6/1970 | Taggart | 114/162 |

FOREIGN PATENT DOCUMENTS

| | | | |
|---|---|---|---|
| 39,445 | 3/1914 | Sweden | 114/162 |

*Primary Examiner*—Trygve M. Blix
*Assistant Examiner*—Sherman D. Basinger
*Attorney, Agent, or Firm*—Clarence A. O'Brien; Harvey B. Jacobson

[57] ABSTRACT

The flap rudder is provided for use on a boat hull including a generally horizontal propeller shaft having a marine propeller mounted thereon and comprises a rudder assembly supported from the hull in horizontal registry with the propeller and for oscillation about an upstanding axis relative to the hull. The rudder assembly includes mounting structure defining a horizontal pivot axis and a rudder member is supported from the mounting structure for oscillation about the aforementioned horizontal pivot axis. The rudder member includes a pair of relatively angulated rudder panels, including adjacent generally parallel marginal edges joined together and along which the aforementioned pivot axis extends, the included angle defined by the rudder panels opening downwardly. The rudder member and mounting structure include coacting structure limiting oscillation of the rudder member relative to the mounting structure through an arc of generally 90°.

9 Claims, 7 Drawing Figures

FLAP RUDDER

BACKGROUND OF THE INVENTION

When a ship's hull is provided with a conventional rudder and the ship is subject to wave action causing the ship to roll, considerable lateral forces are applied to opposite sides of the ship's rudder tending to turn the rudder against the steering mechanism controlling the positioning of the rudder. In addition, conventional ships' rudders also experience excessive side thrusts when the ship is moving downwind through swells or waves and tends to yaw. Still further, single propeller hulls provided with conventional rudders are difficult to steer in one direction (determined by the direction of rotation of the ship's propeller) when moving astern and conventional ships' rudders do not confine any portion of the wash from the propeller with the result that a considerable portion of the rearward thrust developed by the propeller is expended laterally outwardly of the center line of the propeller in all directions thereabout. This, of course, results in inefficient operation and more fuel consumption.

Accordingly, a need exists for a ship's propeller which does not tend to drive the steering mechanism of the propeller when the ship is rolling or yawing and also for a rudder which offers greater steerage when the ship is operated astern and which will function, at least to some degree, to contain the wash of the propeller and thus enable the ship to be more efficiently operated with less fuel consumption.

Examples of various forms of ships' propellers other than conventional propellers and which have been designed to overcome some of the above noted inefficient operating characteristics of conventional ships' propellers are disclosed in U.S. Pat. Nos. 904,313, 2,328,041, 2,896,565, 3,115,112 and 3,828,713.

BRIEF DESCRIPTION OF THE INVENTION

The flap-type rudder of the instant invention includes operating characteristics which substantially reduce all excessive side thrusts on the rudder assembly when the associated ship is experiencing rolling action or yawing action and also includes operating characteristics which improve steerage astern in both directions and increases the driving efficiency of the associated marine propeller.

The main object of this invention is to provide an improved rudder construction which will eliminate the tendency of a ship's rudder to drive the rudder steering mechanism when the associated ship if experiencing rolling or yawing actions.

Another object of this invention is to provide an improved rudder construction which will afford greater steerage astern in both directions.

Still another important object of this invention is to provide a rudder construction which will tend to confine a large portion of the rearward wash from the associated propeller so as to prevent dissipation of the propeller wash in all lateral directions.

Yet another very important object of this invention is to provide an improved rudder construction which may be readily adapted to existing hulls provided with conventional rudder systems.

Another important object of this invention is to provide a rudder construction which will be capable of yielding under impact with a submerged object.

Still another important object of this invention is to provide a rudder construction which will not require as great draft clearance as a conventional rudder.

A final object of this invention to be specifically enumerated herein is to provide an improved ship's rudder construction in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
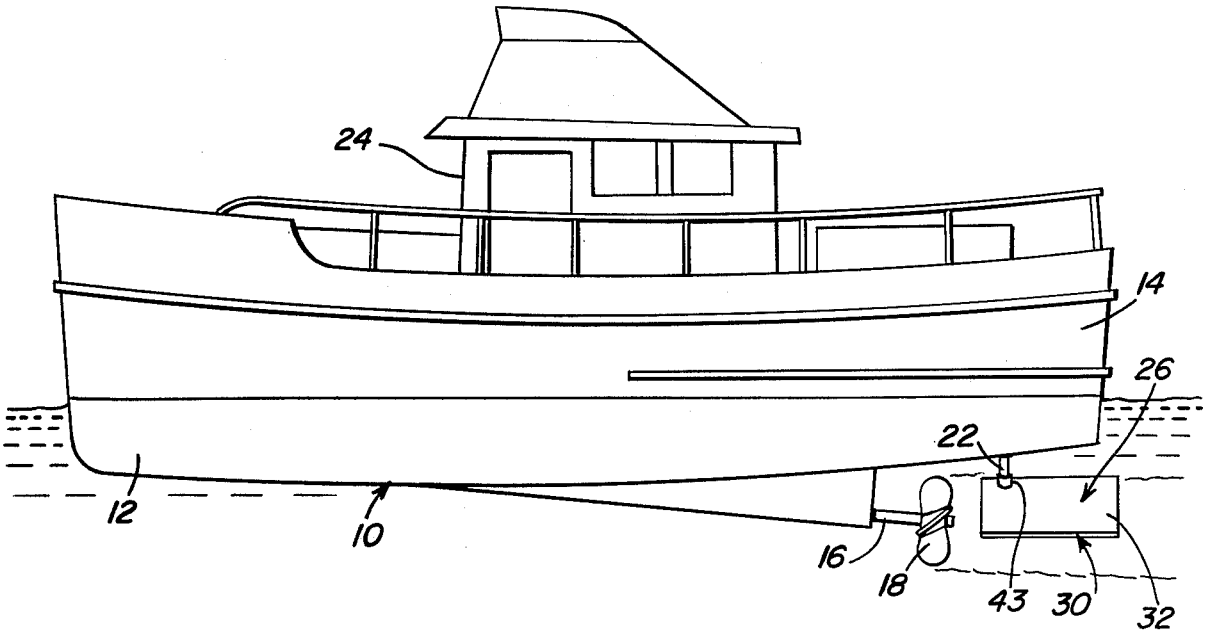
FIG. 1 is a side elevational view of a conventional form of ship's hull equipped with the improved rudder construction of the instant invention.

Referring now more specifically to the drawings, the numeral 10 generally designates a conventional form of a ship's hull, including bow and stern portions 12 and 14. The hull 10 includes a rearwardly projecting generally horizontal propeller shaft 16 upon which a conventional form of marine propeller 18 is mounted. The propeller 18 is centered beneath the hull 10 and the latter includes an upstanding sleeve 20 downwardly through which an oscillatable rudder post 22 is rotatably received. The rudder post 22 may be actuated by any suitable steering mechanism (not shown) controllable from the cabin 24 of the hull 10.

The rudder assembly of the instant invention is referred to in general by the reference numeral 26 and includes a generally horizontal shaft 28 secured to the lower end of the rudder post 22. The forward end of the shaft 28 projects slightly forwardly of the rudder post 22 and terminates a spaced distance rearwardly of the marine propeller 18. The rudder assembly 26 further includes a rudder member referred to in general by the reference numeral 30 and including a pair of substantially planar and rectangular panels 32 and 34 rigidly secured together along adjacent longitudinal marginal edges. The panels 32 and 34 are relatively angulated and define an included angle of generally 90°. A pair of pipe sections or sleeve sections 36 and 38 are oscillatably mounted on the front and rear end portions 40 and 42 of the shaft 28 disposed forward and rearward of the rudder post 22 and the sleeves 36 and 38 are rigidly secured within the apex portion of the included angle defined between the plates 32 and 34. In this manner, the rudder member 30 is oscillatably supported from the shaft 28.

The plates 32 and 34 include partial cylindrical stops 43 and 44 supported therefrom in a plane normal to the panels 32 and 34 and containing the center axis of the rudder post 22. The partial cylindrical stops 43 and 44 are disposed generally normal to the plates 32 and 34 and are seatingly engageable with opposite side portions of the rudder post 22 in order to limit oscillation of the rudder member 30 relative to the shaft 28 to generally 90°. Accordingly, the rudder member 30 may be oscillated between the extreme positions thereof illustrated in phantom lines in FIG. 5 of the drawings.

Figure 3:
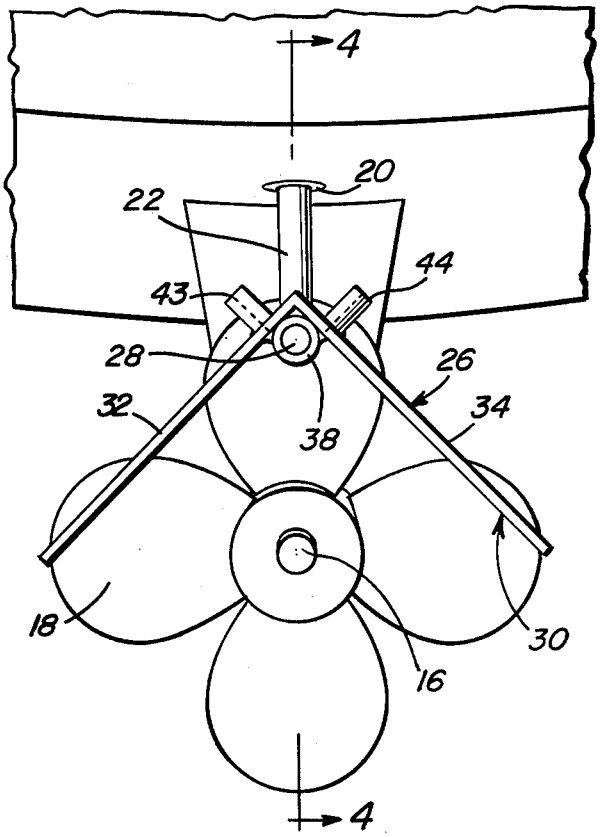
FIG. 3 is a fragmentary, enlarged, rear elevational view of the assemblage illustrated in FIG. 1.
Figure 6:
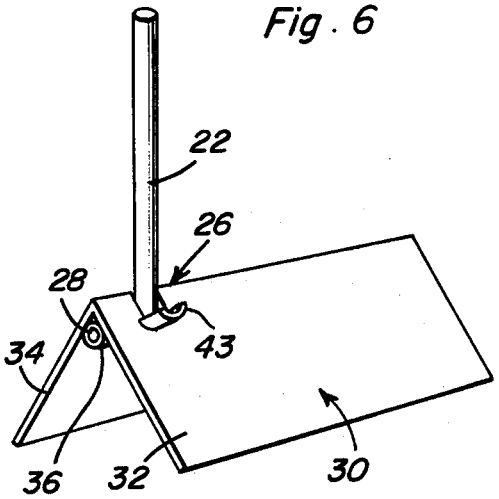
FIG. 6 is a perspective view of the improved rudder construction.
Figure 4:
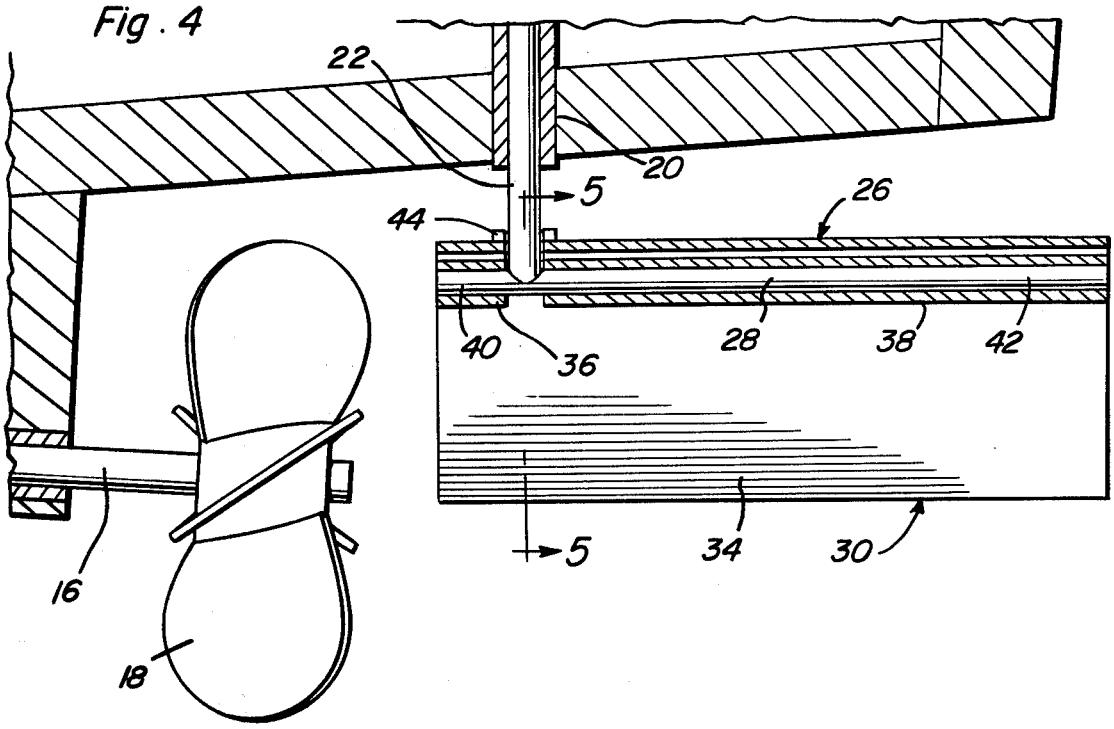
FIG. 4 is an enlarged, fragmentary, longitudinal, vertical sectional view taken substantially upon the plane indicated by the section line 4—4 of FIG. 3.
Figure 5:
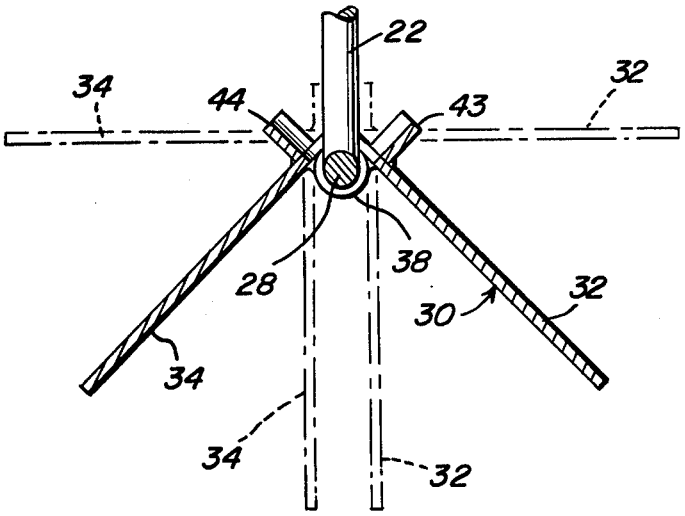
FIG. 5 is a fragmentary, transverse, vertical sectional view taken substantially upon the plane indicated by the section line 5—5 of FIG. 4 and with alternate oscillated positions of the rudder member illustrated in phantom lines.

From FIGS. 3 and 4 of the drawings, it may be seen that the shaft 28 is disposed closely adjacent the uppermost portion of the area through which the marine propeller 18 swings and that the lower edges of the panels 32 and 34 extend downwardly generally to a level of a horizontal plane passing through the rear end of the shaft 16 when the rudder member 30 is in the normal position thereof illustrated in solid lines in FIGS. 3 and 5. It can also be seen that shaft 28 is disposed substantially in the same vertical plane as the propeller shaft, and that the upper edges of panels 32 and 34 are generally parallel to shaft 28.

From FIG. 4 of the drawings, it may be seen that the rearward wash from the propeller 18 will be confined by the rudder member 30 against lateral dissipation through a sector of approximately 180°. Accordingly, the rearward thrust of water from the propeller 18 is more concentrated and thus more efficient to drive the hull 10 resulting in fuel savings. Further, inasmuch as the rudder member 30 is free to oscillate between the limit positions thereof illustrated in phantom lines in FIG. 5, the rudder member 30 does not tend to drive the steering mechanism for the rudder post 22 as a result of the hull 10 rolling or yawing.

Figure 2:
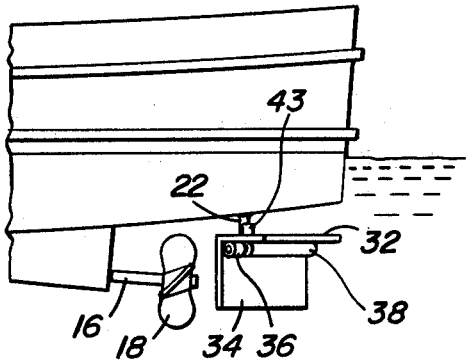
FIG. 2 is a fragmentary, side elevational view of the stern portion of the hull illustrated in FIG. 1 and with the improved rudder construction adjusted to the hard astarboard position.

With attention now invited more specifically to FIG. 2 of the drawings, it will be seen that when the rudder member 30 is moved to the hard astarboard position, the rudder member 30 will swing to a position with the panel 34 disposed substantially vertically and the panel 32 disposed substantially horizontally. In this position, the rudder offers more than conventional steerage and movement of the rudder assembly 26 to the hard aport position causes the rudder member 30 to swing toward its other limit of oscillation.

When the hull 10 is operating in reverse, the angulated panels 32 and 34 offer greater steerage and thus render maneuverability of a single propeller hull more efficient.

Figure 7:
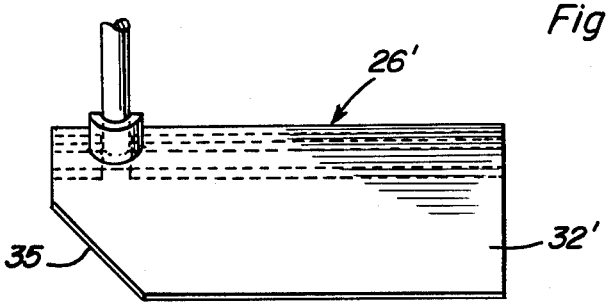
FIG. 7 is a side elevational view of a modified form of improved rudder construction.

With attention invited now more specifically to FIG. 7 of the drawings, there may be seen a modified form of rudder assembly referred to in general by the reference numeral 26'. The rudder assembly 26' is substantially identical to the rudder assembly 26, except that the forward lower corner portions of the panels 32' and 34' are cut away as at 35 to provide propeller clearance when the rudder assembly 26' is adjusted to its extreme positions of angular displacement. Otherwise, the rudder assembly 26' does not differ from the rudder assembly 26 and thus operates in substantially the same manner.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a boat hull including a generally horizontal propeller shaft having a marine propeller mounted thereon, a rudder assembly oscillatably supported from said hull in horizontal registry with and behind said propeller and for angular displacement about an upstanding axis, said rudder assembly including mounting means defining a horizontal pivot axis and a rudder member supported from said mounting means for free oscillation, between limits, about said horizontal pivot axis, said rudder member including a pair of relatively angulated and adjacent rudder panels including adjacent generaly parallel marginal edges joined together, said rudder panels, upon oscillation of said rudder member relative to said mounting means about said horizontal axis, oscillating in unison in the same directions relative to said mounting means, said marginal edges generally paralleling said horizontal pivot axis and the included angle defined by said rudder panels opening downwardly.

2. The combination of claim 1 wherein said panels define an included angle of generally 90°.

3. The combination of claim 1 wherein said rudder member and mounting means include coacting structure limiting oscillation of said rudder member relative to said mounting means through an arc of generally 90°.

4. The combination of claim 3 wherein said panels define an included angle of generally 90°.

5. The combination of claim 4 wherein said panels are generally rectangular with said horizontal pivot axis extending along adjacent longer side edges of said panels.

6. The combination of claim 1 wherein said horizontal pivot axis is disposed closely adjacent a horizontal plane through which the uppermost portions of said propeller swing.

7. The combination of claim 6 wherein said horizontal pivot axis is disposed in substantially the same vertical plane as said propeller shaft when said mounting means is displaced about said upstanding axis to a position with said horizontal pivot axis generally paralleling said propeller shaft.

8. The combination of claim 7 wherein said panels define an included angle of generally 90°.

9. The combination of claim 8 wherein said rudder member and mounting means include coacting structure limiting oscillation of said rudder member relative to said mounting means through an arc of generally 90°.

* * * * *